US009435048B2

(12) United States Patent
Lin et al.

(10) Patent No.: US 9,435,048 B2
(45) Date of Patent: Sep. 6, 2016

(54) LAYER BY LAYER ELECTRO CHEMICAL PLATING (ECP) PROCESS

(71) Applicant: Taiwan Semiconductor Manufacturing Co., Ltd., Hsin-Chu (TW)

(72) Inventors: Su-Horng Lin, Hsinchu (TW); Chi-Ming Yang, Hsinchu (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 637 days.

(21) Appl. No.: 13/778,412

(22) Filed: Feb. 27, 2013

(65) Prior Publication Data

US 2014/0238864 A1 Aug. 28, 2014

(51) Int. Cl.

| | |
|---|---|
| ***C25D 5/18*** | (2006.01) |
| ***C25D 7/12*** | (2006.01) |
| ***C25D 21/12*** | (2006.01) |
| ***C25D 17/00*** | (2006.01) |

(52) U.S. Cl.

CPC . *C25D 5/18* (2013.01); *C25D 7/12* (2013.01); *C25D 17/001* (2013.01); *C25D 21/12* (2013.01)

(58) Field of Classification Search

CPC ..... C25D 5/18
USPC ..... 205/103
See application file for complete search history.

(56) References Cited

U.S. PATENT DOCUMENTS

| | | | | |
|---|---|---|---|---|
| 6,203,684 | B1 * | 3/2001 | Taylor | B23H 5/08 205/103 |
| 6,245,676 | B1 * | 6/2001 | Ueno | C25D 5/18 205/103 |
| 6,309,528 | B1 * | 10/2001 | Taylor | C25D 5/18 205/103 |
| 6,440,289 | B1 * | 8/2002 | Woo | C25D 5/18 205/102 |
| 6,736,953 | B1 * | 5/2004 | Zhu | C25D 5/02 205/103 |
| 2001/0040100 | A1 * | 11/2001 | Wang | C25D 5/026 205/220 |
| 2003/0038036 | A1 * | 2/2003 | Collins | C25D 3/38 205/103 |
| 2004/0265562 | A1 * | 12/2004 | Uzoh et al. | 428/306.6 |
| 2005/0155869 | A1 | 7/2005 | Lin et al. | |

FOREIGN PATENT DOCUMENTS

| | | | |
|---|---|---|---|
| EP | 1069212 | A1 | 1/2001 |
| WO | 2004081262 | A1 | 9/2004 |

* cited by examiner

*Primary Examiner* — Nicholas A Smith

(74) *Attorney, Agent, or Firm* — Eschweiler & Associates, LLC

(57) ABSTRACT

The present disclosure relates to an electro-chemical plating (ECP) process that provides for an isotropic deposition, and a related apparatus. In some embodiments, the disclosed ECP process is performed by providing a substrate into an electroplating solution comprising a plurality of ions of a material to be deposited. A periodic patterned signal, which alternates between a first value and a different second value, is applied to the substrate. When the periodic patterned signal is at the first value, ions from the electroplating solution affix to the substrate. When the periodic patterned signal is at the second value, ions from the electroplating solution do not affix to the substrate. By using the periodic patterned signal to perform electro-chemical plating, the deposition rate of the plating process is reduced, resulting in an isotropic deposition over the substrate that mitigates gap fill problems (e.g., void formation).

20 Claims, 3 Drawing Sheets

LAYER BY LAYER ELECTRO CHEMICAL PLATING (ECP) PROCESS

BACKGROUND

Integrated chips are formed by operating upon a semiconductor workpiece with a plurality of different processing steps. Deposition processes are widely used on varying surface topologies in both front-end-of-the-line (FEOL) and back-end-of-the-line (BEOL) processing. For example, in FEOL processing deposition processes may be used to form polysilicon material on a substantially flat substrate, while in BEOL processing deposition processes may be used to form metal interconnect layers within a cavity in a dielectric layer. Deposition processes may be performed by a wide range of deposition tools, including physical vapor deposition (PVD) tools, electro-chemical plating (ECP) tools, atomic layer deposition (ALD) tools, etc.

DETAILED DESCRIPTION

Figure 1:
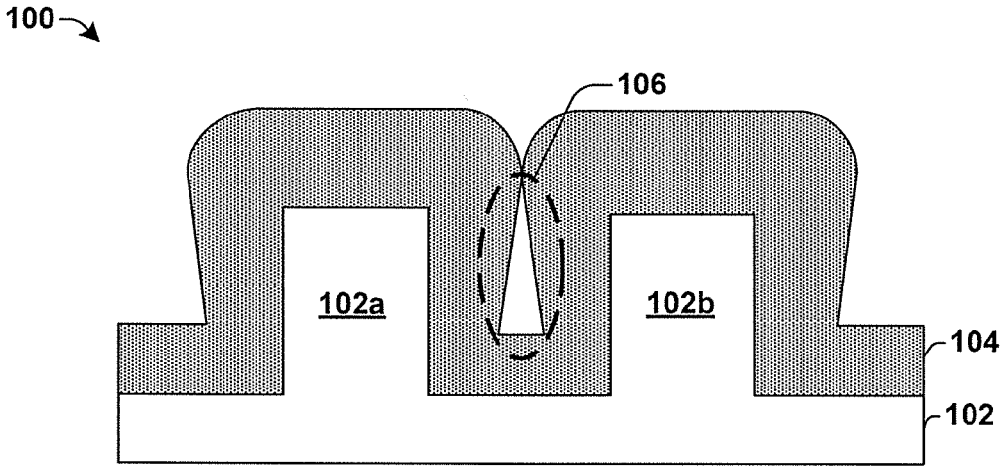
FIG. 1 illustrates a cross-sectional view of a substrate having a layer deposited by a conventional electro-chemical plating (ECP) process.

The description herein is made with reference to the drawings, wherein like reference numerals are generally utilized to refer to like elements throughout, and wherein the various structures are not necessarily drawn to scale. In the following description, for purposes of explanation, numerous specific details are set forth in order to facilitate understanding. It will be appreciated that the details of the figures are not intended to limit the disclosure, but rather are non-limiting embodiments. For example, it may be evident, however, to one of ordinary skill in the art, that one or more aspects described herein may be practiced with a lesser degree of these specific details. In other instances, known structures and devices are shown in block diagram form to facilitate understanding.

Typically, a number of different deposition processes may be used during fabrication of an integrated chip. The different deposition processes may include physical vapor deposition (PVD) processes, atomic layer deposition (ALD) processes, and electro-chemical plating (ECP) processes. However, each of these deposition processes has drawbacks that limit their usefulness during semiconductor processing. For example, PVD processes deposit thin films having poor step coverage. Conversely, ALD processes use complicated deposition chemistries to deposit films having good step coverage, but which provide for a low throughput, and which use precursor gases having a high carbon content that increases a resistance of deposited metals.

ECP processes deposit material onto a substrate by electrolytic deposition. For example, a substrate may be submerged into an electroplating solution comprising ions of a material to be deposited. A DC voltage is applied to the substrate to attract ions from the electroplating solution to the substrate. The ions condense on the substrate to form a thin film. It has been appreciated that the DC voltage provides for a high deposition rate that causes gap fill problems (e.g., forms voids) for high aspect ratios present in advanced technology nodes (e.g., in 32 nm, 22 nm, 16 nm, etc.).

For example, FIG. 1 illustrates a cross-sectional view 100 of a semiconductor substrate upon which an ECP deposition process has been carried out. As shown in cross-sectional view 100, a deposited layer 104 is formed by an ECP process on a semiconductor substrate 102 having a plurality of steps, 102*a* and 102*b*, comprising a large height-to-width aspect ratio. The aspect ratio of the steps, 102*a* and 102*b*, causes deposited layer 104 to provide poor step coverage on sidewalls of the steps, 102*a* and 102*b*. The poor step coverage may result in a void 106 in the deposited layer 104 that can be detrimental to integrated chip operation.

Accordingly, the present disclosure relates to an electro-chemical plating (ECP) process that provides for an isotropic deposition that improves gap-fill capability. In some embodiments, the disclosed ECP process comprises providing a substrate into an electroplating solution comprising a plurality of ions of a metal to be deposited. A periodic patterned signal, which alternates between a first value and a different second value, is applied to the substrate. When the periodic patterned signal is at the first value, ions from the electroplating solution affix to the substrate. When the periodic patterned signal is at the second value, ions from the electroplating solution do not affix to the substrate. By using the periodic patterned signal to perform electro-chemical plating, the deposition rate of the plating process is reduced, resulting in an isotropic deposition over the substrate that mitigates gap fill problems (e.g., void formation).

Figure 2:
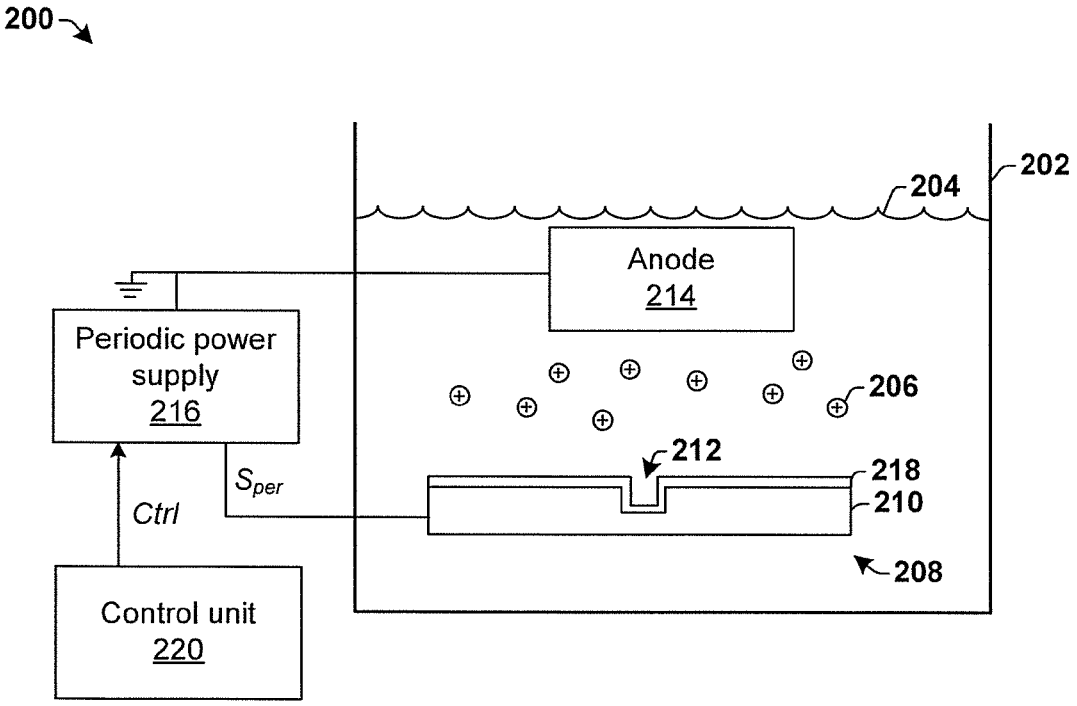
FIG. 2 illustrates a block diagram of some embodiments of a disclosed electro-chemical plating (ECP) system.

FIG. 2 illustrates a block diagram of some embodiments of a disclosed electro-chemical plating (ECP) system 200.

The ECP system 200 comprises a container 202. The container 202 is configured to hold an electroplating solution 204 comprising a plurality of ionized molecules of a material to be deposited (i.e., ions 206). In some embodiments, the plurality of ions 206 may comprise ions of a metal barrier layer (e.g., SiOCH, $SiO_2$, etc.), a metal seed layer (e.g., Copper), or a metal bulk layer. In one example, the plurality of ions 206 may comprise copper ions.

A cathode 208 is disposed within the electroplating solution 204. The cathode 208 is electrically connected to a substrate 210 that is to be plated. In some embodiments, the substrate 210 may comprise a semiconductor substrate (e.g., a silicon substrate, a GaAs substrate, etc.) having a surface topology with one or more cavities 212.

In some embodiments, an anode 214 may also be disposed within the electroplating solution 204. In some embodiments, the anode 214 may comprise a source of a material (e.g., copper) that is to be plated onto the substrate 210. In such embodiments, a voltage difference between the anode 214 and the electroplating solution 204 causes atoms of the anode 214 to be ionized, allowing the atoms to dissolve in the electroplating solution 204. In some embodiments, the anode 214 is electrically connected to a ground terminal.

A periodic power supply 216 is electrically connected to the cathode 208 by way of a first conductive path. The periodic power supply 216 is configured to provide a periodic patterned signal $S_{per}$ to the cathode 208. In various embodiments, the periodic patterned signal $S_{per}$ may comprise a voltage or a current. In some embodiments, the periodic power supply 216 is configured to generate a periodic patterned signal $S_{per}$ comprising a voltage that varies between a first voltage value and a second voltage value as a function of time. For example, the periodic power supply 216 may output a periodically patterned voltage having a first value during a first time period, a second value during a second time period, the first voltage value during a third time period, etc.

The varying value of the periodic patterned signal $S_{per}$ causes the disclosed ECP system 200 to form a deposited layer 218 on the substrate 210 by way of a layer-by-layer deposition. This is because the periodic patterned signal $S_{per}$ will cause the ECP system 200 to alternate between periods in which material is deposited onto the substrate 210 (e.g., periods in which the periodic patterned signal $S_{per}$ causes ions 206 to be attracted to the substrate 210) and periods in which material is not deposited onto the substrate 210 (e.g., periods in which the periodic patterned signal $S_{per}$ does not cause ions 206 to be attracted to the substrate 210).

The layer-by-layer deposition process provides the disclosed ECP system 200 with a slower deposition rate than ECP systems using a DC power source. The slower deposition speed (achieved due to the varying value of the periodic patterned signal $S_{per}$) results in an isotropic deposition of the deposited layer 218 onto the substrate 210. For example, the slow deposition rate will deposit a material on a bottom surface of a cavity 212 that has a thickness that is substantially equal to the thickness of a material deposited on sidewalls of the cavity 212. The isotropic deposition improves gap fill and reduces voids within a deposited layer.

In some embodiments, the periodic patterned signal $S_{per}$ may have maximum and minimum values that cause the ECP system 200 to alternate between electrodissolution processes (i.e., dissolving a material from the substrate 210) and electrodeposition processes (i.e., depositing a material on the substrate 210). For example, when the periodic power supply 216 outputs a periodic patterned signal $S_{per}$ having a value that violates (e.g., is below) a first threshold, the disclosed ECP system 200 will undergo an electrodeposition process. During the electrodeposition process, ions 206 are attracted to the substrate 210, increasing a thickness of the deposited layer 218 on the substrate 210. When the periodic power supply 216 outputs a periodic patterned signal $S_{per}$ having a value that violates (e.g., is above) a second threshold, the ECP system will undergo electrodissolution. During the electrodissolution process, plated atoms on the substrate 210 are ionized and dissolved as ions 206 in the electroplating solution 204, decreasing a thickness of the deposited layer 218.

In some embodiments, the ECP system 200 further comprises a control unit 220 configured to generate a control signal ctrl that causes the periodic power supply 216 to dynamically vary one or more parameters (e.g., a maximum voltage, a minimum voltage, etc.) of the periodic patterned signal $S_{per}$ to control deposition characteristics of the layer-by-layer deposition. For example, by varying the one or more parameters of the periodic patterned signal $S_{per}$, the deposition rate of the deposited layer 218 may be varied. In some embodiments, the control unit 220 may be configured to control one or more parameters of a periodic patterned signal $S_{per}$ comprising a square wave, including: a maximum voltage, a minimum voltage, a time at the maximum voltage, or a time at the minimum voltage.

Figure 3:
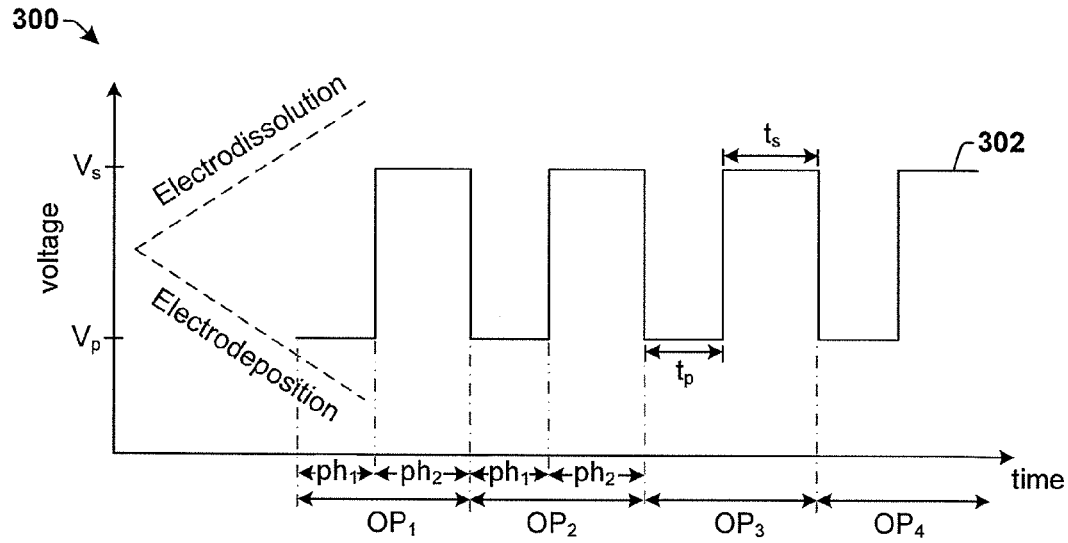
FIG. 3 illustrates a timing diagram of some embodiments of an exemplary operation of disclosed electro-chemical plating (ECP) system.

FIG. 3 shows a timing diagram 300 illustrating an exemplary operation of a disclosed periodic power supply (e.g., corresponding to periodic power supply 216). Although timing diagram illustrates a periodic patterned signal having a square waveform, it will be appreciated that the disclosed periodic patterned signal is not limited to such waveforms. Rather, the periodic patterned signal may comprise a sinusoidal waveform, or any other periodical patterned waveforms. Furthermore, although the periodic patterned signal is illustrates as a periodic patterned voltage, one of ordinary skill in the art will appreciate that in alternative embodiments, the periodic patterned signal may comprise a periodic patterned current.

As shown in timing diagram 300, the periodic patterned voltage 302 comprises a plurality of operating periods $OP_1$-$OP_4$. Respective operating periods comprise a first phase $ph_1$ and a second phase $ph_2$. During the first phase $ph_1$, the periodic patterned voltage 302 has a value of $V_p$ for a time $t_p$. During the second phase $ph_2$, the periodic patterned voltage 302 has a value of $V_s$ for a time $t_s$. The varying voltage of the periodic patterned signal $S_{per}$ during respective operating periods, $OP_1$-$OP_4$, results in distinct periods of deposition during which a layer of deposited material is formed on a substrate separated by periods where deposition does not occur. Over time, the distinct periods of deposition caused by the periodic patterned voltage 302 results in a layer-by-layer deposition of material onto the substrate.

For example, during a first operating period ($OP_1$) the periodic patterned voltage 302 operates to form a first deposited layer. During a first phase $ph_1$ of the first operating period $OP_1$, the periodic power supply provides the first voltage $V_p$ to the cathode for a time $t_p$. The first voltage $V_p$ operates to pull ions from an electroplating solution towards the cathode, resulting in a first deposited layer on the cathode (e.g., substrate) through a process of electrodeposition. During a second phase $ph_2$ of the first operating period $OP_1$, the periodic power supply provides the second voltage $V_s$ to the cathode for a time $t_s$. The second voltage $V_s$ operates to remove atoms from the cathode by oxidizing the atoms through a process of electrodissolution, which provides the oxidized ions into the electroplating solution as positively charged ions. The removal of atoms reducing a thickness of the first deposited layer.

During a second phase of the second operating period ($OP_2$), the periodic patterned voltage 302 operates to form a second deposited layer. During a first phase $ph_1$ of the second operating period $OP_2$, the periodic power supply provides the first voltage $V_p$ to the cathode for a time $t_p$. The first voltage $V_p$ operates to pull ions towards the cathode, resulting in a second deposited layer on the cathode (e.g., substrate). During a second phase $ph_2$ of the first operating period $OP_1$, the periodic power supply provides the second voltage $V_s$ to the cathode for a time $t_s$. The second voltage $V_s$ operates to remove atoms from the cathode, reducing a thickness of the second deposited layer. During subsequent operating periods (e.g., $OP_3$, $OP_4$, etc.) additional layers may be formed onto the cathode (e.g., substrate).

It will be appreciated that by varying one or more parameters (e.g., $V_s$, $V_p$, $t_s$, $t_p$) of the periodic patterned signal $S_{per}$ properties of the layer-by-layer ECP (e.g., layer thickness, crystal size, etc.) deposition can be varied. In some embodiments, $t_s$ and $t_p$ can be made to have values that are different from one another to form an asymmetric square wave. For example, in some embodiments, time $t_p$ that can be set to have a value that is greater than a value of time $t_s$. By increasing the value of $t_p$ relative to $t_s$ the deposition speed will increase.

Figure 4:
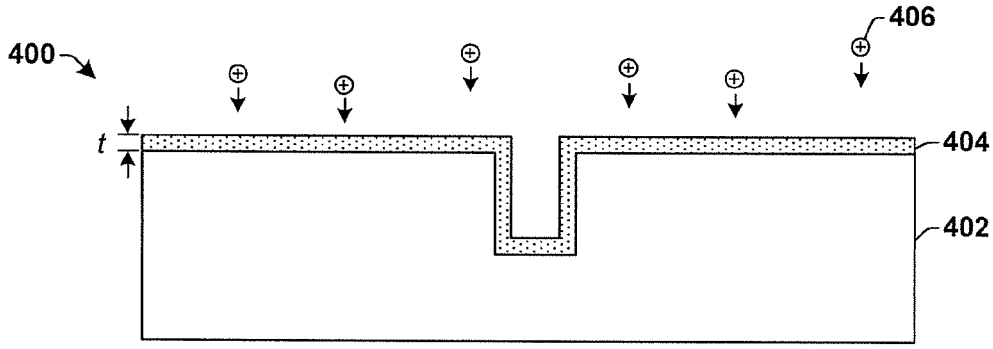
FIGS. 4-6 illustrate cross-sectional views of some embodiments of an exemplary semiconductor wafer, whereon a layer-by-layer deposition according to the ECP process of the timing diagram of FIG. 3 is implemented.
Figure 5:
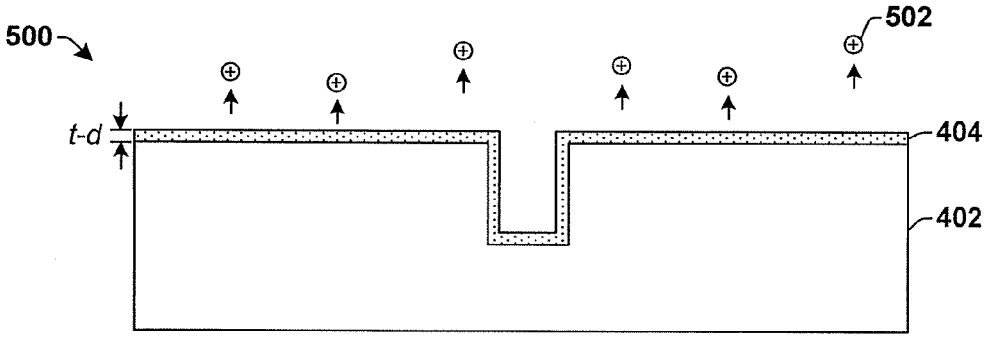
Figure 6:
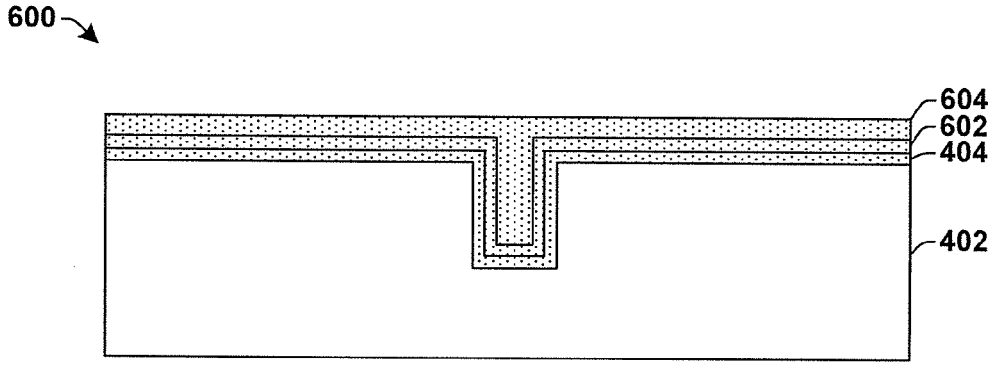

FIGS. 4-6 illustrate cross-sectional views of some embodiments of an exemplary semiconductor wafer, whereon a layer-by-layer deposition according to timing diagram 300 is implemented. Although FIGS. 4-6 are described in relation to timing diagram 300, it will be appreciated that the structures disclosed in FIGS. 4-6 are not limited to such a timing diagram. Rather, it will be appreciated that the illustrated structures of FIGS. 4-6 provide for a structural description of an electro-chemical plating (ECP) system that is able to stand alone independent of a timing diagram (e.g., a waveform).

FIG. 4 illustrates some embodiments of a cross-sectional view 400 showing an example of an electrodeposition process performed during a first phase of an operating period. As shown in cross-sectional view 500, during a first phase of the operating period, a first voltage value $V_p$ causes ions 406 from an electroplating solution to be deposited onto a substrate 402. This results in the formation of a first deposited layer 404 having a first thickness of $t_1$. In some embodiments, the first deposited layer 404 may comprise a section of a back-end-of-the-line (BEOL) metallization layer formed in a trench within a dielectric material on a semiconductor substrate. In such embodiments, the first deposited layer may comprise a copper metal or an aluminum metal, for example.

FIG. 5 illustrates some embodiments of a cross-sectional view 500 showing an example of an electrodissolution process performed during a second phase of an operating period. As shown in cross-sectional view 500, during a second phase of the operating period the second voltage value $V_s$ causes material to be removed from the substrate 402 as ions 502, which are introduced back into the electroplating solution. The removal of material from the substrate 402 reduces a thickness of the first deposited layer 404 to a second thickness of $t_1$-d.

FIG. 6 illustrates some embodiments of a cross-sectional view 600 showing deposition of deposited layers during subsequent operating periods. As shown in cross-sectional view 600, during a first subsequent operating period a second deposited layer 602 is formed onto the first deposited layer 404. The second deposited layer 602 may have same thickness as the first deposited layer 404 or a different thickness than the first deposited layer 404, depending on one or more parameters of the periodic patterned voltage. During a second subsequent operating period a third deposited layer 604 is formed onto the second deposited layer 602. The third deposited layer 604 may have same thickness as the second deposited layer 602 or a different thickness than the second deposited layer 602, depending on one or more parameters of the periodic patterned voltage.

Figure 7:
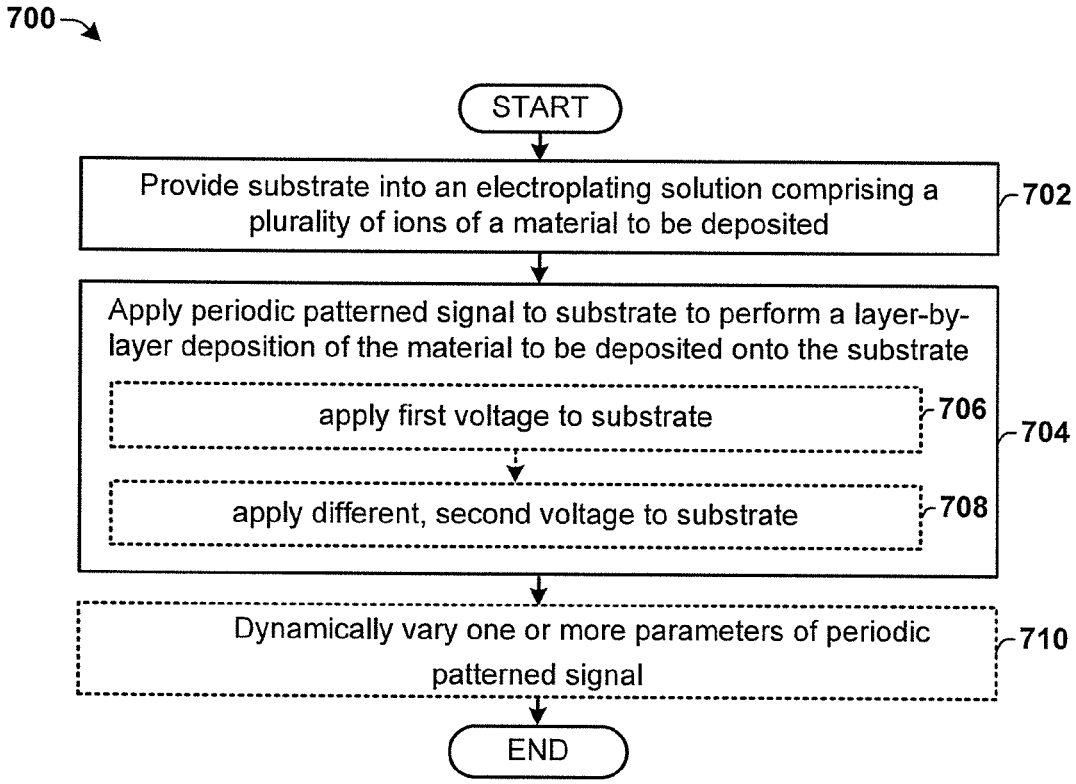
FIG. 7 is a flow diagram of some embodiments of a method of performing an electro-chemical plating (ECP) process.

FIG. 7 is a flow diagram of some embodiments of a method 700 of performing an electro-chemical plating (ECP) process.

While the disclosed method 700 is illustrated and described below as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the description herein. Further, one or more of the acts depicted herein may be carried out in one or more separate acts and/or phases.

At act 702, a substrate is provided into an electroplating solution. The electroplating solution comprises a plurality of ions of a material to be deposited onto the substrate. In various embodiments, the plurality of ions may comprise ions of a metal barrier layer (e.g., SiOCH, $SiO_2$, etc.), a metal seed layer (e.g., copper), or a metal bulk layer. In some embodiments, the electroplating solution may further comprise an anode comprising a material to be deposited onto the substrate.

At act 704, a periodic patterned signal is applied to the substrate. The periodic patterned signal causes a layer-by-layer deposition of the material to be deposited onto the substrate. The layer-by-layer deposition has distinct periods of deposition separated by periods in which no deposition occurs. In some embodiments, the periodic patterned signal may alternate between a first value and a different second value as a function of time. The first value causes ions from the electroplating solution to affix to the substrate. The second value causes ions from the electroplating solution to not affix to the substrate. In some embodiments, the periodic patterned signal causes method 700 to vary between an electrodeposition of material onto the substrate and an electrodissolution of material from the substrate.

In some embodiments, the periodic patterned signal comprises a plurality of operating periods having a first phase and a second phase. During the first phase (act 706) a first voltage is applied to the semiconductor substrate. The first voltage causes material to be deposited onto the substrate. During a subsequent, second phase (act 708) a second voltage is applied to the substrate. The second voltage causes material to not be deposited onto the substrate.

At act 710, one or more parameters of the periodic patterned signal may be varied to adjust deposition parameters of the layer-by-layer deposition. In some embodiments, one or more parameters of a periodic patterned voltage or current comprising a square wave may be varied. In such embodiments the one or more parameters may include: a maximum voltage, a minimum voltage, a time at the maximum voltage, or a time of the minimum voltage.

It will be appreciated that while reference is made throughout this document to exemplary structures in discussing aspects of methodologies described herein, those methodologies are not to be limited by the corresponding structures presented. Rather, the methodologies and structures are to be considered independent of one another and able to stand alone and be practiced without regard to any of the particular aspects depicted in the Figs.

Also, equivalent alterations and/or modifications may occur to one of ordinary skill in the art based upon a reading and/or understanding of the specification and annexed drawings. The disclosure herein includes all such modifications and alterations and is generally not intended to be limited thereby. For example, although the figures provided herein are illustrated and described to have a particular doping type, it will be appreciated that alternative doping types may be utilized as will be appreciated by one of ordinary skill in the art.

In addition, while a particular feature or aspect may have been disclosed with respect to one of several implementations, such feature or aspect may be combined with one or more other features and/or aspects of other implementations as may be desired. Furthermore, to the extent that the terms "includes", "having", "has", "with", and/or variants thereof are used herein, such terms are intended to be inclusive in meaning—like "comprising." Also, "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ from that illustrated herein.

Therefore, the present disclosure relates to an electro-chemical plating (ECP) process, and a related apparatus, which provide for an isotropic deposition that improves step coverage of a substrate.

In some embodiments, the present disclosure relates to a method of electro-chemical plating. The method comprises providing a substrate into an electroplating solution comprising a plurality of ions of a material to be deposited. The method further comprises applying a periodic patterned signal, having a plurality of operating periods, to the substrate. Respective operating periods are configured to form a deposited layer onto the substrate. Respective operating periods have a first phase that attracts one or more of the plurality of ions from the electroplating solution to the substrate and a second phase that does not attract the ions from the electroplating solution to the substrate.

In other embodiments, the present disclosure relates to a method electro-chemical plating. The method comprises providing a substrate into an electroplating solution comprising a plurality of ions of material to be deposited. The method further comprises applying a periodic patterned signal, which alternates between a first value and a different second value, to the substrate. The first value causes one or more of the plurality of ions from the electroplating solution to affix to the substrate as a deposited layer, and wherein the second value causes one or more of the plurality of ions from the electroplating solution to not affix to the substrate, thereby resulting in distinct periods of deposition that cause a layer-by-layer deposition.

In other embodiments, the present disclosure relates to an electro-chemical plating (ECP) system. The ECP system comprises a container comprising an electroplating solution having a plurality of ions of a material to be deposited. The ECP system further comprises a cathode comprised within the electroplating solution and electrically connected to a substrate. The ECP system further comprises a periodic power supply configured to apply a periodic patterned signal to the substrate having a plurality of operating periods, which respectively form a deposited layer onto the substrate. Respective operating periods have a first phase that attracts one or more of the plurality of ions from the electroplating solution to the substrate and a second phase that does not attract the ions from the electroplating solution to the substrate.

What is claimed is:

1. A method of electro-chemical plating, comprising:

providing a substrate have a trench into an electroplating solution comprising a plurality of ions of a material to be deposited;

filling the trench with a plurality of deposited layers, which respectively have a uniform thickness of the material along sidewalls and a lower surface of the trench, wherein each of the plurality of deposited layers are formed during separate operating periods of a periodically patterned signal comprising a square waveform that transitions from a second voltage to a first voltage at an end of each of the plurality of operating periods, and wherein the separate operating periods respectively comprise a first phase in which the first voltage is applied to a cathode in electrical contact with the substrate to attract one or more of the plurality of ions from the electroplating solution to the substrate and a second phase in which the second voltage is applied to the cathode to dissociate deposited ions from the substrate back into the electroplating solution; and dynamically varying one or more parameters of the square waveform including: a maximum voltage or a minimum voltage.

2. The method of claim 1, wherein during the first phase the first voltage is applied to the cathode for a first amount of time, and wherein during the second phase the second voltage is applied to the cathode for a second amount of time that is equal to the first amount of time.

3. The method of claim 1, wherein the periodically patterned signal comprises an asymmetric square wave having a maximum voltage for a first time and a minimum voltage for a second time that is different than the first time.

4. A method of electro-chemical plating, comprising:

providing a substrate having a trench into an electroplating solution comprising a plurality of ions of a material to be deposited;

filling the trench by sequentially forming a plurality of deposited layers respectively having a uniform thickness of the material along sidewalls and a lower surface of the trench, wherein the plurality of deposited layers are formed by applying a periodic patterned signal to the substrate, which alternates between a first value and a different second value during formation of each of the plurality of deposited layers;

dynamically varying one or more parameters of the periodic patterned signal including: a maximum voltage or a minimum voltage; and wherein the first value causes one or more of the plurality of ions from the electroplating solution to affix to the substrate as a deposited layer, and wherein the second value causes one or more ions to dissociate from the deposited layer, thereby reducing a thickness of the deposited layer.

5. The method of claim 4, wherein the periodic patterned signal comprises a plurality of operating periods, which respectively form separate deposited layers onto the substrate.

6. The method of claim 4, wherein the periodic patterned signal comprises a square waveform that transitions from the second value to the first value at an end of each of the plurality of operating periods; and wherein during a first one of the plurality of operating periods the square waveform consists of the first value and the second value.

7. The method of claim 6, wherein the periodically patterned signal comprises an asymmetric square wave having a maximum voltage for a first time and a minimum voltage for a second time that is different than the first time.

8. The method of claim 4, wherein the periodic patterned signal comprises a sinusoidal waveform.

9. The method of claim 4, wherein the periodic patterned signal comprises a periodic patterned voltage or a periodic patterned current.

10. The method of claim 1, wherein during the second phase a thickness of a layer deposited onto the substrate during the first phase is reduced from a first thickness to a second thickness that is less than the first thickness.

11. The method of claim 1, wherein the first voltage is less than the second voltage.

12. The method of claim 4, wherein the first value is less than the second value.

13. The method of claim 1, wherein the plurality of ions comprise ions of a metal barrier layer, a metal seed layer, or a metal bulk layer.

14. The method of claim 1, wherein the substrate comprises a dielectric material on a semiconductor substrate.

15. A method of electro-chemical plating, comprising:

providing a substrate having a trench into an electroplating solution comprising a plurality of ions of a metal material to be deposited;

filling the trench by sequentially forming a plurality of deposited layers respectively having a uniform thickness of the metal material along sidewalls and a lower surface of the trench, wherein the plurality of deposited layers are formed by applying a periodic patterned signal to the substrate, which alternates between a first voltage value and a different second voltage value during formation of each of the plurality of deposited layers;

dynamically varying one or more parameters of the periodic patterned signal including: a maximum voltage or a minimum voltage; and wherein the first voltage value causes one or more of the plurality of ions of the metal material to affix to the substrate as a deposited layer, and wherein the second voltage value causes one or more ions to dissociate from the deposited layer, thereby reducing a thickness of the deposited layer.

16. The method of claim 15, wherein the plurality of deposited layers comprise a top deposited layer comprising a 'T' shaped structure.

17. The method of claim 15, wherein the metal material comprises copper.

18. The method of claim 15, wherein the substrate comprises a dielectric material on a semiconductor substrate.

19. The method of claim 15, wherein the periodic patterned signal comprises a square waveform.

20. The method of claim 19, wherein the square waveform comprises an asymmetric square waveform.

* * * * *